United States Patent [19]

Galloway

[11] 4,360,325

[45] Nov. 23, 1982

[54] GAS-TO-HYDRAULIC POWER CONVERTER

[75] Inventor: Charles W. Galloway, Friendswood, Tex.

[73] Assignee: The United States of America as represented by the Administrator of the National Aeronautics and Space Administration, Washington, D.C.

[21] Appl. No.: 238,785

[22] Filed: Feb. 27, 1981

[51] Int. Cl.[3] ..... F04B 9/10

[52] U.S. Cl. ..... 417/399; 74/110

[58] Field of Search ..... 417/399; 74/110; 92/2, 92/31, 33

[56] References Cited

U.S. PATENT DOCUMENTS

| | | | |
|---|---|---|---|
| 2,688,951 | 9/1954 | Sears | 74/110 X |
| 3,141,387 | 7/1964 | Geyer | 92/33 |
| 3,170,605 | 2/1965 | Dryden | 417/399 X |
| 3,777,580 | 12/1973 | Brems | 74/110 |

*Primary Examiner*—Leonard E. Smith

*Attorney, Agent, or Firm*—Carl O. McClenny; John R. Manning; Marvin F. Matthews

[57] ABSTRACT

A gas piston driven hydraulic piston pump in which the gas cycle is of high efficiency by injecting the gas in slugs at the beginning of each power stroke. The hydraulic piston (40) is disposed to operate inside the gas piston (30), and the two pistons, both slidably but non-rotatably mounted, are coupled together with a rotating but non-sliding motion transfer ring (50) extending into antifriction grooves (46 and 37) in the sidewalls (42 and 32) of the two pistons. To make the hydraulic piston move at a constant speed during constant hydraulic horsepower demand and thus exert a constant pressure on the hydraulic fluid, these grooves are machined with variable pitches and one is the opposite of the other, i.e., the gas piston groove (37) increases in pitch during its power stroke while the hydraulic piston groove (46) decreases. Thus the motion transfer ring (50) is properly denominated a force multiplier ring. Any number of piston assembly sets may be used to obtain desired hydraulic horsepower.

10 Claims, 4 Drawing Figures

1,2

3
9
14
12
8
10
31
35
30
52
5
32
36
7
33
59
58
34
43
42
41
4
16
15
45
6
20
18
40
44
46
48
56
11
47
51
37
50
54

GAS-TO-HYDRAULIC POWER CONVERTER

ORIGIN OF THE INVENTION

The invention described herein was made by an employee of the United States Government and may be manufactured and used by or for the Government of the United States of America as governmental purposes without the payment of any royalties thereon or therefor.

DESCRIPTION

Technical Field

The present invention is concerned with mechanical means for pumping hydraulic fluids by extracting the energy from a motive high pressure gas with high efficiency. Secondly, it is concerned with pumping the hydraulic fluid under constant pressure for constant hydraulic horsepower demand. The invention may also be called a high efficiency free-piston hydraulic pump. Obviously, it may be driven in reverse to operate as a gas compressor.

Background of the Invention

The invention may be used in a space vehicle, which dictates a hydraulic pump occupying less space and having a weight less than conventional gas turbine powered rotating hydraulic pumps. It also demands a pump requiring less maintenance and looser tolerances, and one in which parts that are prone to wear out are quickly and cheaply replaced.

Prior Art

The nearest known art is found in U.S. Pat. Nos. 3,170,605; 3,613,169; 3,823,651; 3,961,559; 4,192,482 and 3,695,785. None of these, however, embody the applicant's concept of extracting maximum energy from the driving gas in a blowdown chamber and providing a force multiplier ring which couples the gas piston to the hydraulic piston by engaging variable pitch grooves in both pistons.

GENERAL DISCLOSURE OF THE INVENTION

The present invention utilizes an outer cylindrical housing and piston having a blow-down chamber at one end, and an inner cylinder and piston at the other (hydraulic) end, the inner assembly extending coaxially within the outer piston and being reversed from end to end so that the head of the inner piston exerts pressure on hydraulic fluid admitted through the hydraulic end of the outer cylinder.

The driving gas in the blowdown chamber is not vented out of the assembly until the outer (or gas) piston nears the end of its stroke and uncovers an appropriately located vent or until varying in port 12 is switched to vent. This, of course, means that the pressure driving the gas piston is considerably lower during the last part of the stroke by comparison with the starting pressure. To prevent a like reduction in the force exerted by the hydraulic piston on the fluid being pumped, the two pistons are coupled together by a force multiplier ring which is mounted on the inner cylinder so that it can be rotated but not moved axially (while both pistons move axially but can not be rotated).

To ensure that the pressure on the hydraulic fluid does not diminish from its starting value during a constant hydraulic horsepower demand, even though the gas pressure is allowed to fall off as the gas expands, this ring is mounted to engage both a first helical groove in the inner surface of the gas piston and a second helical groove in the outer surface of the hydraulic piston.

Each of these grooves is of variable pitch, and one is the opposite of the other. The pitch of the gas piston groove increases as this piston passes through its stroke, while the pitch of the hydraulic piston groove decreases correspondingly. Since each groove must pass through the same axial point continuously, i.e., where the anti-friction bearing surfaces of the force multiplier ring enter the grooves, movement of the gas piston an axial distance corresponding to one revolution of its helical groove rotates the ring by camming action, and the same camming action on the hydraulic piston forces it to advance an axial distance corresponding to one revolution of its helical groove. The mathematical form of the helices is determined from the requirement that the pressure exerted by the hydraulic piston remain constant during constant hydraulic horsepower demand while the gas pressure gradually falls off, and will be apparent to those of ordinary skill in the art. The variable pitch profile may be tailored to match a hot gas thermal pressure decay profile; again, such technique will be apparent to those of ordinary skill in the art. The hydraulic pressure capability is determined by the gas to hydraulic piston area ratio and the initial gas pressure.

The invention provides further applications in weight, cost, and space savings by providing a compact unit which can be designed as an integral part of a hydraulic actuator.

The gas and hydraulic piston area ratio may be reversed if high flow-low pressure hydraulic power is desired.

BRIEF DESCRIPTION OF THE DRAWING

The present patent includes a drawing illustrating one preferred embodiment of the invention. In such drawing.

DETAILED DESCRIPTION OF THE DRAWING

Figure 1:
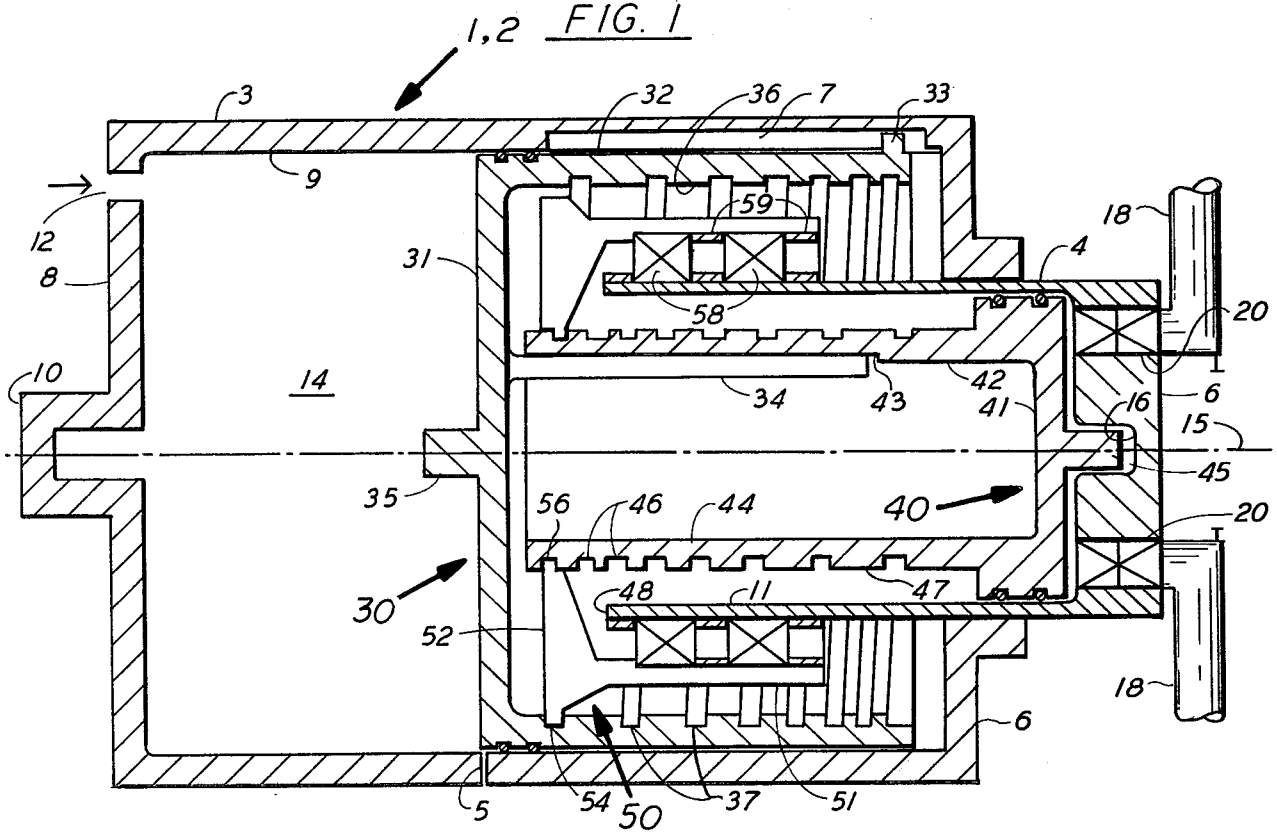
FIG. 1, consisting of one piston set, is a somewhat conceptualized depiction of the invention in longitudinal section, this view showing the pistons at the end of a power stroke.

The figures show a one piston set assembly in which the fixed parts of the gas-to-hydraulic power converter 1 include the outer cylinder 2 and the inner or smaller cylinder 4, the latter being an integral extension from the hydraulic closer end 6 of the outer cylinder 2; this cylinder is coaxial with the outer cylinder and spaced therefrom by an annulus. The opposed end 8 of the outer cylinder, containing the damper half 10, may be denominated the gas closure 8 because it contains the gas entry port 12, and because this end of the cylinder 2 contains the blowdown chamber 14. A similar damper half is provided by the blind hole 16 in the hydraulic closure 6. Hydraulic fluid is admitted through this closure by one of the conduits 18, with the flow directionally controlled by valves 20. Hydraulic fluid is pumped out the other conduit 18.

Figure 4:
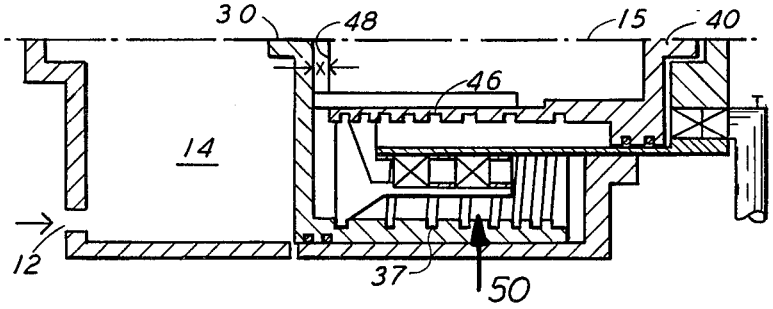

The outer or gas cylinder 2 has a cylindrical sidewall 3 provided with an exhaust vent 5. As shown in FIGS. 1 and 4, this vent is not uncovered to permit the escape of the driving gas until the pistons have completed their power stroke. The sidewall 3 also contains an axial groove 7 formed from its bore surface 9, such groove serving as a guide for the gas piston 30 and preventing rotation of the piston by its engagement of the bearing lug 33 protruding from the outer surface of gas piston 30.

The principal moving parts of the depicted gas-to-hydraulic power converter 1 are the gas piston 30, the hydraulic piston 40, and the force multiplier ring 50. As illustrated, the gas piston 30 has the integrally connected head 31 facing the gas closure end 8 of the cylinder and the open-ended cylindrical sidewall 32 extended toward the hydraulic end 6. The hydraulic piston 40 is oppositely disposed within the cylindrical sidewall 4 of the inner cylinder, i.e., with its head 41 facing the hydraulic end 6 of the assembly and with its open-ended cylindrical sidewall 42 extending toward the gas end. Each of the pistons 30 and 40 is axially slideable within its cylinder, making sealing contact with inner sidewall surfaces 9 and 11 respectively, using the indicated seals. Rotation of the gas piston 30 is prevented by the above mentioned interfit of bearing lug 33 in groove 7 of cylinder wall 3, while rotation of the hydraulic piston 40 is prevented by a bearing lug 34 projecting from the head 31 of gas piston 30 into an axial groove 43 of hydraulic piston sidewall 42.

As seen in FIG. 1, the head 41 of hydraulic piston 40 has a damper half 45 which engages the damper half 16. These two elements form a damper to reduce metal-to-metal impact load between the piston and the closure as hydraulic piston 40 reaches the end of its stroke. A similar half damper 35 projecting from the head 31 of gas piston 30 engages the half damper 10 of gas closure 8, for the same purpose. Various damper types other than that illustrated could be used.

It will be noted that as the pistons are depicted in FIG. 1, the sidewall 42 of hydraulic piston 40 extends beyond the sidewall 4 of the inner cylinder, and confronts the inner surface 36 of the gas piston sidewall 32 across an unobstructed annulus. The ring 50 or rather the head 52 thereof is disposed in this space and extends across it so that outside antifriction bearing surface 54 extends into a helical groove 37 in the sidewall 32 of the gas piston, from inside surface 36, and inside antifriction bearing surface 56 extends into another helical groove 46 formed in the hydraulic piston sidewall 42 from its outer surface 47. The ring 50 also includes the sleeve portion 51 disposed coaxially about the common axis 15 of the assembly and integrally secured to the head portion 52. The sleeve portion 51 is rotatably mounted on the inner cylinder 4 by means of the indicated bearings 58, which together with spacers 59 also serve to prevent the ring 50 from making any axial movement.

Figure 2:
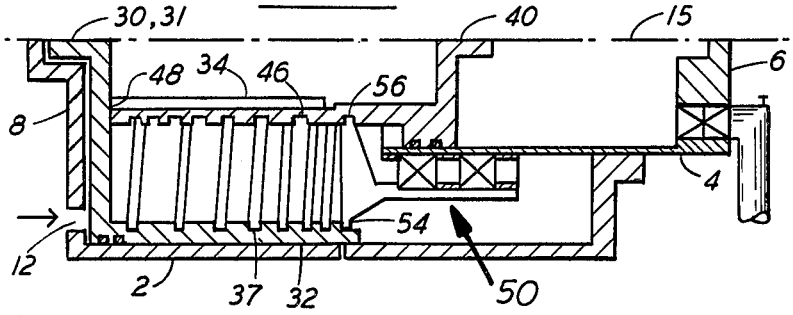
FIGS. 2, 3 and 4 are half-sections similar to FIG. 1, showing in rather schematic form the relative positions of the pistons at the start, intermediate and final positions they occupy during a power stroke, respectively (FIG. 4 being the same as FIG. 1).

In operation, the pistons 30 and 40 are moved from the position of FIG. 1 to the starting position of FIG. 2 by utilizing the hydraulic fluid from inlet conduit 18 as the driving fluid; this is readily accomplished because the blowdown chamber 14 has just been exhausted of any high pressure gas, and inlet gas valving 12 ducts to exhaust.

Turning to FIG. 2, it will first be noted that the relative positions of the pistons 30 and 40 are such that the free end 48 of hydraulic piston 40 is in contact with the head 31 of gas piston 30, and the antifriction bearing surfaces 54 and 56 of the ring 50 are near the extreme right hand ends of the two variable pitch grooves 37 and 46. A predetermined quantity ("slug") of gas is admitted to the blowdown chamber 14 through entry vent 12, for instance by connecting vent 12 to an auxiliary storage tank (not shown) by a valve (not shown). The important feature is that this slug of gas has an initial pressure and an initial mass, and thereafter there are no additions to the mass of the gas until the cycle is ready to be replicated. The gas may be a hot gas resulting from a decomposition process carried on in an auxiliary chamber, or integral to chamber 14, or may be a compressed cold gas held therein intermittently, i.e., disconnected from any compressed gas source during the power strokes of the pistons.

As this slug of gas acts on piston head 31, it causes piston 30 to move toward the hydraulic closure 6 of the assembly, increasing the size of chamber 14. As the sidewall slides in this direction, the trailing wall defining its helical groove 37 cams the engaging antifriction bearing surface 54 to rotate ring 50 and its inside antifriction bearing surface 56. Antifriction bearing surface 56 in turn rotates against the leading wall defining helical groove 46 of the hydraulic piston 40, causing this piston to advance. Since the pitches of the two grooves are opposed, that of groove 37 in the gas piston 30 increasing (by comparison with FIG. 2) while groove 46 of the hydraulic piston 40 is decreasing, during the first stages of the power stroke the hydraulic piston necessarily advances farther than the gas piston. This may be seen in FIG. 3 by the distance "X", which is precisely the excess of the advance of piston 40 over that of piston 30. Since in this figure each piston has advanced an axial distance corresponding to 4 revolutions of the ring 50, as may be seen by counting groove tracks from right to left in FIG. 3, the distance "X" is also equal to the difference in the axial spacings of these groove tracks, between track 1 and track 5.

Figure 3:
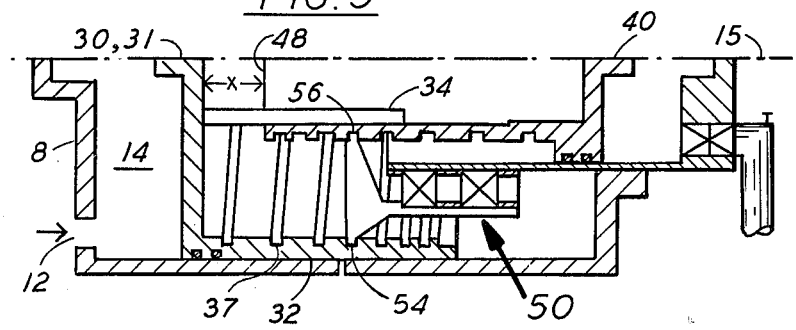

In proceeding from the FIG. 3 intermediate position to the FIG. 4 end position of the pistons, which in the illustration corresponds to 3 revolutions of the ring 50, the gas piston 30 moves through the higher pitch portions of its groove 37 while the hydraulic piston 40 moves through its smaller pitch portions. Stated another way, the force multiplier functioning is such that the hydraulic piston 40 necessarily moves a shorter distance than the gas piston 30, as may be seen by comparing the distance "X" in the two figures. As previously mentioned, such relative movement results from the requirement of injecting a slug of gas at the outset and letting it decrease in pressure as it drives the gas piston and at the same time keeping a constant pressure on the hydraulic fluid, or in other words moving the hydraulic piston at a constant velocity during constant hydraulic horsepower demand.

Among the advantages of the invention are the space and weight savings resulting from the high efficiency gas cycle; if the gas pressure were kept constant at an elevated pressure during the entire power stroke, more gas generating and storage equipment would be required. In addition it may be pointed out that the two pistons and the force multiplier ring are easily replaced, that close fit clearances are not required between either piston and its cylinder (as in conventional hydraulic piston pumps), and that there are no rotating shaft seals, as is common in prior art hydraulic pumps, that frequently cause early failures thereof.

Another advantage is that the pistons are stationary, that is not stroking, when zero hydraulid flow is required although the hydraulic pressure is maintained. This contrast to constant rotating pumps, either electric motor or turbine powered.

By utilizing proper external or port valving, multiple piston set assemblies may be included to reduce stroke switching pressure ripple and/or increase flow capacity. Such techniques will be apparent to those of ordinary skill in the art.

In multiple piston set assembly pumps, the expended gas from one cylinder may, through a design configuration change, be used to help return another piston assembly set to its starting position. This modification will also be apparent to those of ordinary skill in the art.

It is to be understood that the foregoing description of a particular preferred embodiment is illustrative only, and that the scope of the invention is to be limited only as limited in the appended claims, which should be broadly construed to embrace all substantially similar means for accomplishing substantially the same result in a substantially similar manner.

What is claimed is:

1. A gas-to-hydraulic power converter comprising:

A. A hollow outer cylinder closed at both ends, said cylinder having a sidewall, a gas closure end and a hydraulic closure end, B. A gas piston slideable within the outer cylinder in sealing contact with the sidewall thereof and engaging the same by interfitting antifriction tongue and grooves to prevent rotation of the gas piston, said gas piston having as integrally joined portions a head facing said gas closure end of the cylinder and a cylindrical sidewall making said sealing contact with the sidewall of the cylinder, said sidewall of the gas piston having a bore surface in which a helical groove is formed, said groove having a multiplicity of revolutions and being of variable pitch, such pitch decreasing from its end closer to said gas closure end of the outer cylinder and proceeding toward the hydraulic closure end thereof, C. A smaller diameter hollow disposed within said outer cylinder and coaxial therewith, such smaller cylinder being secured to the hydraulic closure end of the outer cylinder and extending axially thereinto a distance less than the axial extent of the sidewall of the gas piston, D. A hydraulic piston axially slidable within said smaller cylinder and having as integrally joined parts a head facing the hydraulic closure end of the outer cylinder and a cylindrical sidewall making sealing contact with the inner surface of the smaller cylinder, said sidewall of the hydraulic piston being longer than said smaller cylinder and having an outer cylindrical surface containing a helical groove of several revolutions and of variable pitch, such pitch increasing from its end closer to the gas closure end of the outer cylinder and proceeding to its end closer to the hydraulic end thereof, E. A motion transfer ring having integrally connected sleeve and head portions, the sleeve portion being mounted on and surrounding said smaller cylinder to be rotatable but not translatable with respect thereto while the head portion is secured to the gas closure end of such sleeve, said head portion extending between the bore surface of the gas piston and the outer surface of the hydraulic piston and having at such extremities a pair of opposed antifriction bearing surfaces engaging said annular groove of the gas piston and said annular groove of the hydraulic piston, whereby any axial movement of either piston is necessarily accompanied by axial movement of the other piston, albeit at a different speed, except at mid stroke, and means for admitting a quantity of gas at the gas closure end of the outer cylinder, means for exhausting such gas, and means for admitting hydraulic fluid and exhausting the same to and from the space between the hydraulic closure end of the outer cylinder and the head of the hydraulic piston.

2. A gas-to-hydraulic power converter comprising an outer piston and cylinder assembly, an inner piston and cylinder assembly disposed within and coaxial with said outer assembly, and a motion transfer ring rotatably but not translatably mounted between the two assemblies and having opposed antifriction bearing surface portions engaging helical grooves in the sidewalls of the two pistons, in the inner surface of the outer portion and in the outer surface of the inner piston, each of such grooves varying in pitch from one end to the other, said outer assembly having opposed gas closure and hydraulic closure ends and the pitch of its helical groove decreasing from a maximum at its end nearer to said gas closure end to a minimum pitch at the other end of such groove while the pitch of the helical groove of the inner piston increases between its corresponding ends, each of said pistons being mounted within its cylinder to be translatable but not rotatable with respect thereto.

3. The gas-to-hydraulic power converter of claim 2 in which each of said gas and hydraulic pistons has a starting position adjacent the gas closure end of the outer cylinder, a final position adjacent the hydraulic closure end of the outer cylinder, and infinite positions inbetween.

4. The gas-to-hydraulic power converter of claim 2 in which the gas closure end of the outer cylinder is provided with port means and other means for admitting a predetermined quantity of gas into the adjacent portion of the cylinder cavity, the outer piston having a head facing the closure and defining with it a gas blow-down chamber which is also defined in part by a portion of the sidewall of the outer cylinder, such chamber expanding in size as the gas acts on the piston and being limited by an exhaust vent in such sidewall located at or adjacent to the location of the piston head at the end of its power stroke.

5. The gas-to-hydraulic power converter of claim 4 in which the pitch of the helices engaged by the motion transfer ring is determined by the two requirements (1) that the inner piston advance toward the hydraulic closure end of the cylinder while exerting constant pressure on hydraulic fluid during constant hydraulic horsepower demand admitted through the hydraulic closure end, and (2) admitting a slug of gas at the outset of each power stroke of the pistons, when both are disposed adjacent the gas closure end of the outer cylinder, and thereafter closing said end, whereby the pressure of the gas driving the gas piston declines throughout its power stroke until said exhaust port is unveiled.

6. The gas-to-hydraulic power converter of claim 4 in which said hydraulic end of the outer cylinder supports and secures said inner cylinder, such inner cylinder extending within the outer cylinder and terminating in an open end, and said inner piston is slidably disposed within such inner cylinder in sealing relationship therewith, has a head portion facing said hydraulic closure end, and has an axial extent longer than that of the inner cylinder.

7. The gas-to-hydraulic power converter of claim 6 in which said motion transfer ring has integrally connected sleeve and head portions, the sleeve portion surrounding and being rotatably and non-translatably mounted on said inner cylinder while the head portion is disposed to contact that portion of the extent of the inner piston exceeding the length of the inner cylinder.

8. The gas-to-hydraulic power converter of claim 7 in which said hydraulic closure end of the outer cylinder is provided with vent and directional valve means for controllably admitting and permitting the outflow of hydraulic fluid to and from said inner cylinder in the space between the head of the inner piston, the inner cylinder, and said hydraulic closure end.

9. The gas-to-hydraulic power conveter of claim 8 in which said hydraulic closure end and said head of the inner piston are provided with interengaging means serving as a dashpot or damper to reduce metal-to-metal contact loads as the piston approaches such end.

10. The gas-to-hydraulic power converter of claim 9 in which the head of the gas piston and the gas closure end of the outer cylinder are provided with intergaging means forming a dashpot or damper, to reduce metal-to-metal contact loads as the piston approaches such end.

* * * * *